US007431027B2

(12) United States Patent
Carpenter et al.

(10) Patent No.: US 7,431,027 B2
(45) Date of Patent: Oct. 7, 2008

(54) ROTATIONAL QUICK RELEASE PAINTBALL HOPPER COUPLER

(75) Inventors: Dale Carpenter, 930 N. Portland, Gilbert, AZ (US) 85234; Jason Scott Henley, Mesa, AZ (US)

(73) Assignee: Dale Carpenter, Gilbert, AZ (US)

( * ) Notice: Subject to any disclaimer, the term of this patent is extended or adjusted under 35 U.S.C. 154(b) by 304 days.

(21) Appl. No.: 11/288,849

(22) Filed: Nov. 29, 2005

(65) Prior Publication Data

US 2006/0076000 A1 Apr. 13, 2006

Related U.S. Application Data

(62) Division of application No. 10/758,713, filed on Jan. 16, 2004, now Pat. No. 7,178,515.

(51) Int. Cl.
*F41B 11/02* (2006.01)

(52) U.S. Cl. ..... 124/49; 285/33

(58) Field of Classification Search ..... 124/45, 124/49, 51.1; 285/33, 276, 277, 358, 359, 285/394, 395

See application file for complete search history.

(56) References Cited

U.S. PATENT DOCUMENTS

| | | | | |
|---|---|---|---|---|
| 263,415 | A | 8/1882 | Lightburne | |
| 919,743 | A | 4/1909 | Mason | |
| 1,443,455 | A * | 1/1923 | Brown | 285/277 |
| 2,135,223 | A * | 11/1938 | Scheiwer | 285/111 |
| 4,198,080 | A | 4/1980 | Carpenter | |
| 5,103,771 | A | 4/1992 | Lee | |
| 5,257,615 | A | 11/1993 | Jones | |
| 6,374,819 | B1 * | 4/2002 | Ming-Hsien | 124/49 |
| 6,588,412 | B2 | 7/2003 | Ferrara et al. | |
| 6,591,824 | B2 | 7/2003 | Hatcher | |
| 6,655,991 | B2 | 12/2003 | Heebe | |
| 6,739,322 | B2 * | 5/2004 | Rice et al. | 124/49 |
| 7,178,515 | B2 * | 2/2007 | Carpenter et al. | 124/49 |
| 2002/0134205 | A1 | 9/2002 | Hsu | |

* cited by examiner

*Primary Examiner*—John Ricci
(74) *Attorney, Agent, or Firm*—Letham Law Firm LLC; Lawrence Letham

(57) ABSTRACT

An apparatus for releasably coupling a provided paintball hopper to a provided paintball marker. The apparatus includes a marker mount, a feed neck, a plurality of spheres, and a retaining sleeve. The marker mount includes an axial passage and a plurality of bores perpendicular to the passage. The feed neck includes an axial passage and a plurality of cavities. The retaining sleeve includes a plurality of voids. The marker mount for coupling to the paintball marker. The feed neck for coupling to the paintball hopper. Each one cavity is separate from any other cavity. Each bore includes a first end portion and a second end portion respectively. One sphere is moveably positioned in each bore. The feed neck slidably engages the marker mount. The retaining sleeve is biased in a locked position and rotationally movable to an unlocked position. In the unlocked position, each sphere partially protrudes from the first end portion of its respective bore into a respective void of the plurality of voids. In the locked position, each sphere protrudes from the second end portion of its respective bore into one cavity of the plurality cavities. A portion of each sphere substantially fills its respective cavity thereby holding the feed neck rotationally immobile with respect to the marker mount.

20 Claims, 9 Drawing Sheets

ROTATIONAL QUICK RELEASE PAINTBALL HOPPER COUPLER

CROSS-REFERENCE TO RELATED APPLICATIONS

This application is a Divisional Application of U.S. application No. Ser. 10/758,713 filed Jan. 16, 2004, now U.S. Pat. 7,178,515 and entitled QUICK RELEASE FIXED POSITION PAINTBALL HOPPER COUPLER.

BACKGROUND OF THE INVENTION

1. Field of the Invention

This invention pertains generally to pneumatic markers or guns, and more particularly to a coupler that releaseably attaches a paintball hopper to a paintball marker.

2. Description of Related Art

Current paintball hoppers come with a fitting that attaches to the paintball marker, then the hopper is pressed into the fitting and is held in place by friction. Paintballs exit the hopper, traverse the fitting, and go into the marker for firing. Generally, hoppers are removed from the marker for storage or transport, thereby necessitating removal of the hopper from the fitting. A friction fit can at times make removing the hopper difficult. An object of this invention is to provide a method of quickly and easily disconnecting the paintball hopper from the paintball marker while at the same time holding the hopper immobile when in use.

BRIEF SUMMARY OF THE INVENTION

An aspect of the invention is an apparatus, referred to as a coupler, that couples a paintball hopper to a paintball marker.

Another aspect of the invention are the quick connect and quick release characteristics of the coupler.

An apparatus for releasably coupling a provided paintball hopper to a provided paintball marker. The apparatus includes a marker mount, a feed neck, a plurality of spheres, and a retaining sleeve. The marker mount includes an axial passage and a plurality of bores perpendicular to the passage. The feed neck includes an axial passage and a plurality of cavities. The retaining sleeve includes a plurality of voids. The marker mount for coupling to the paintball marker. The feed neck for coupling to the paintball hopper. Each one cavity is separate from any other cavity. Each bore includes a first end portion and a second end portion respectively. One sphere is moveably positioned in each bore. The feed neck slidably engages the marker mount. The retaining sleeve is biased in a locked position and rotationally movable to an unlocked position. In the unlocked position, each sphere partially protrudes from the first end portion of its respective bore into a respective void of the plurality of voids. In the locked position, each sphere protrudes from the second end portion of its respective bore into one cavity of the plurality cavities. A portion of each sphere substantially fills its respective cavity thereby holding the feed neck rotationally immobile with respect to the marker mount.

A paintball marker system, comprising a paintball hopper, a paintball marker, and a coupler that releasably couples the paintball hopper to the paintball marker. The coupler includes a marker mount, a feed neck, a plurality of spheres, and retaining sleeve. The marker mount includes an axial passage and a plurality of bores perpendicular to the passage. The feed neck includes an axial passage and a plurality of cavities. The retaining sleeve includes a plurality of voids. The marker mount couples to the paintball marker. The feed neck couples to the paintball hopper. Each one cavity is separate from any other cavity. Each bore having a first end portion and a second end portion respectively. One sphere is moveably positioned in each bore. The feed neck slidably engages the marker mount. The retaining sleeve is biased in a locked position and rotationally movable to an unlocked position. In the unlocked position, each sphere partially protrudes from the first end portion of its respective bore into a respective void of the plurality of voids. In the locked position, each sphere protrudes from the second end portion of its respective bore into one cavity of the plurality cavities. A portion of each sphere substantially fills its respective cavity thereby holding the feed neck rotationally immobile with respect to the marker mount.

An apparatus for releasably coupling a provided paintball hopper to a provided paintball marker, comprising a marker mount, a feed neck, a plurality of spheres, and a retaining sleeve. The marker mount includes an axial passage and a plurality of bores. The feed neck having an axial passage and a plurality of cavities. The marker mount for coupling to the paintball marker. The feed neck for coupling to the paintball hopper. Each one cavity is separate from any other cavity. Each bore having a first end portion respectively. One sphere is moveably positioned in each bore. The feed neck slidably engages the marker mount. The retaining sleeve is biased in a locked position and rotationally movable to an unlocked position. In the locked position, each sphere protrudes from the first end portion of its respective bore into one cavity of the plurality cavities. A portion of each sphere substantially fills its respective cavity thereby holding the feed neck rotationally immobile with respect to the marker mount.

BRIEF DESCRIPTION OF THE SEVERAL VIEWS OF THE DRAWING(S)

The invention will be more fully understood by reference to the following drawings which are for illustrative purposes only:

Figure 1:
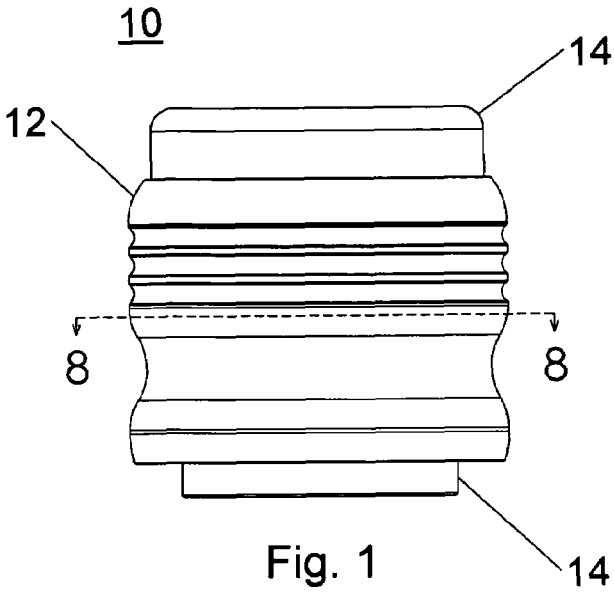
FIG. 1 is a side view of the first and second embodiments of the invention.
Figure 8:
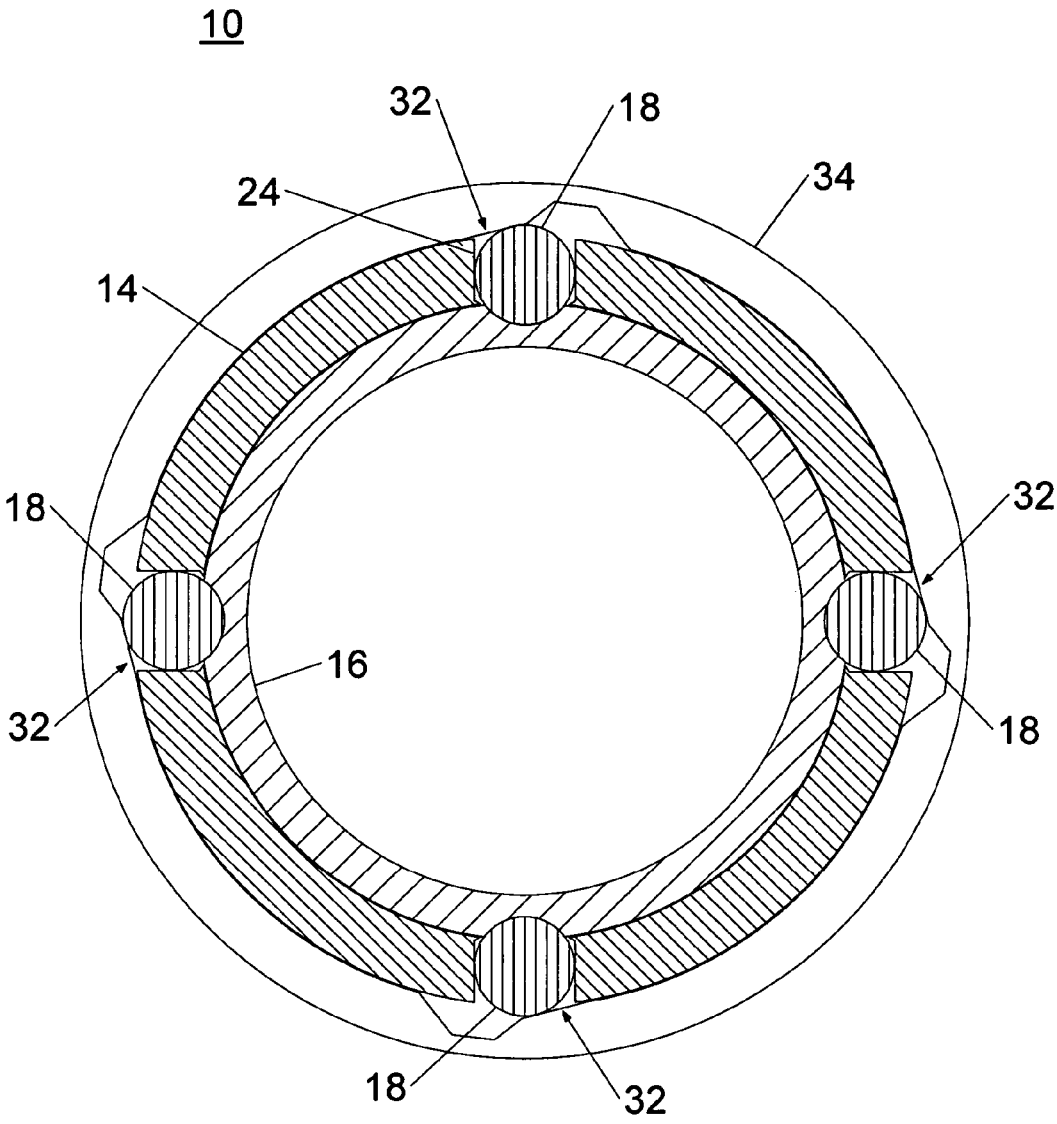
Figure 9:
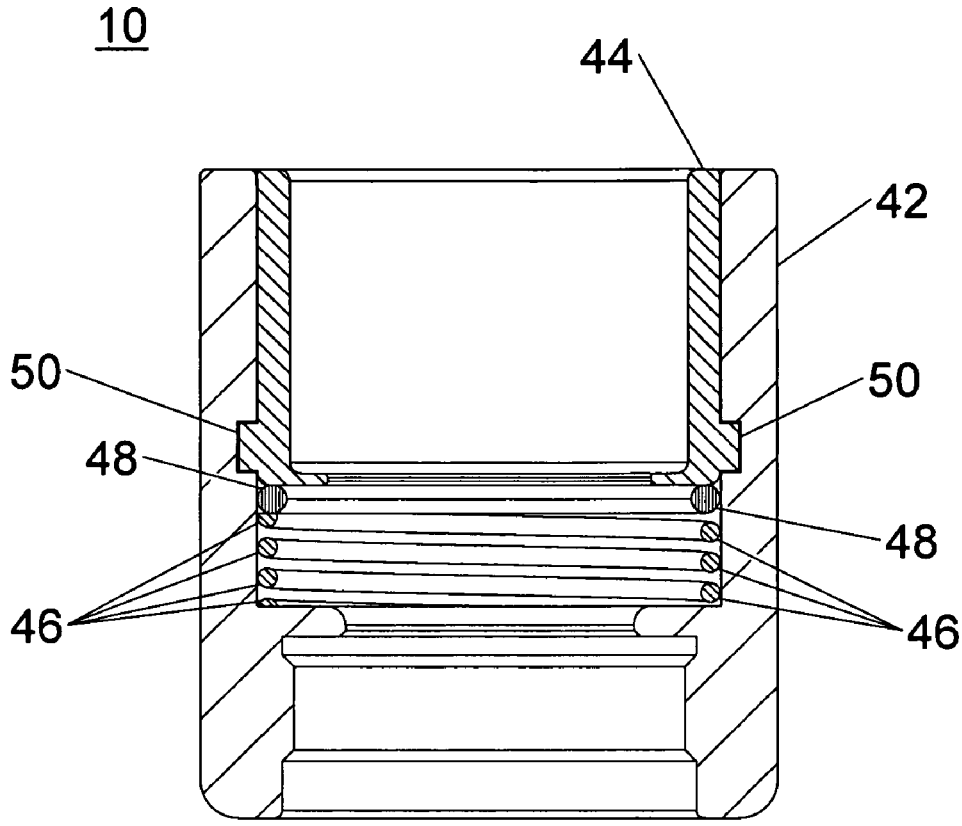
Figure 10:
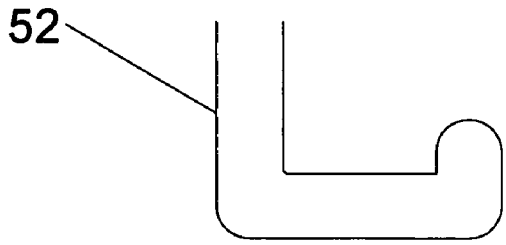
Figure 11:
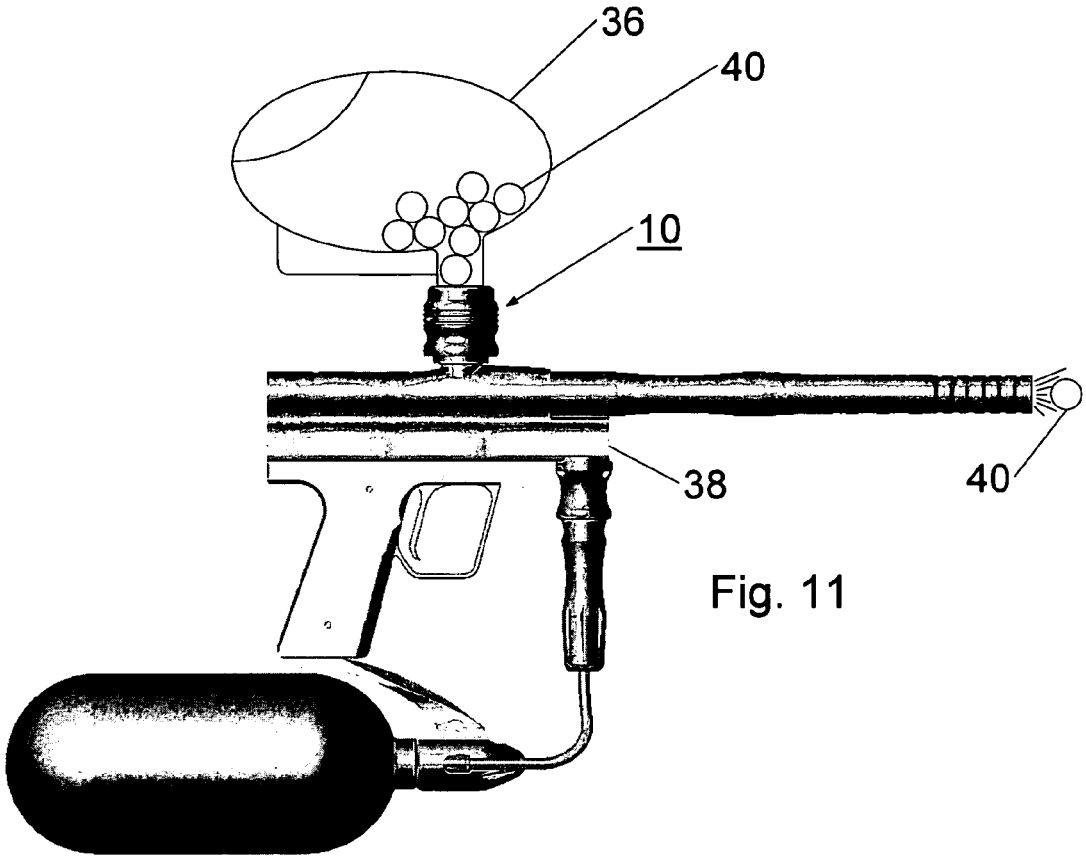

FIG. 8 a cross-sectional view of the second embodiment of the invention of FIG. 1 taken along the line 8-8 showing locking ramp with the coupler in the locked position;

FIG. 9 is a cross-sectional view of the third embodiment of the invention;

FIG. 10 is a diagram of groove used in the third embodiment of the invention;

FIG. 11 is a diagram a paintball marker system where the paintball hopper is coupled to the paintball marker using an embodiment of the invention.

DETAILED DESCRIPTION OF THE INVENTION

Referring more specifically to the drawings, for illustrative purposes the present invention is embodied in the apparatus generally shown in FIG. 1 through FIG. 11. It will be appreciated that the apparatus may vary as to configuration and as to details of the parts, and that the method may vary as to the specific steps and sequence, without departing from the basic concepts as disclosed herein.

Figure 2:
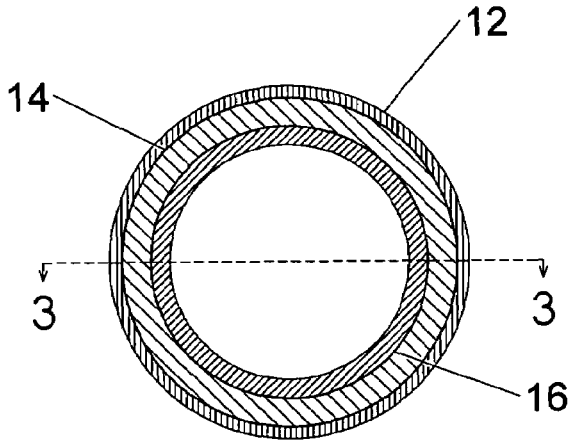
FIG. 2 is a top view of the first and second embodiments of the invention in FIG. 1.

Three possible embodiments of the invention are disclosed in this application. The first embodiment is the preferred embodiment. Turning to FIG. 1, a coupler 10 is shown having a retaining sleeve 12 and a marker mount 14. The bottom of the marker mount 14, as shown in FIG. 1, connects to a paintball marker 38 as shown in FIG. 11. Referring to FIG. 2, a top view of the first embodiment shows the retaining sleeve 12, the marker mount 14, and the feed neck 16. The feed neck 16 connects to the paintball hopper 36 (see FIG. 11) and is insertable into and removable from the marker mount 14. The complete paintball marker system is shown in FIG. 11, where a paintball hopper 36 connects to the coupler 10 and the coupler 10 connects to a paintball marker 38. The coupler 10 allows paintballs 40 to pass from the paintball hopper 36, through the coupler 10, and into the paintball marker 38 where they are launched. The coupler 10 enables the paintball hopper 36 to easily be connected to or disconnected from the paintball marker 38.

Figure 3:
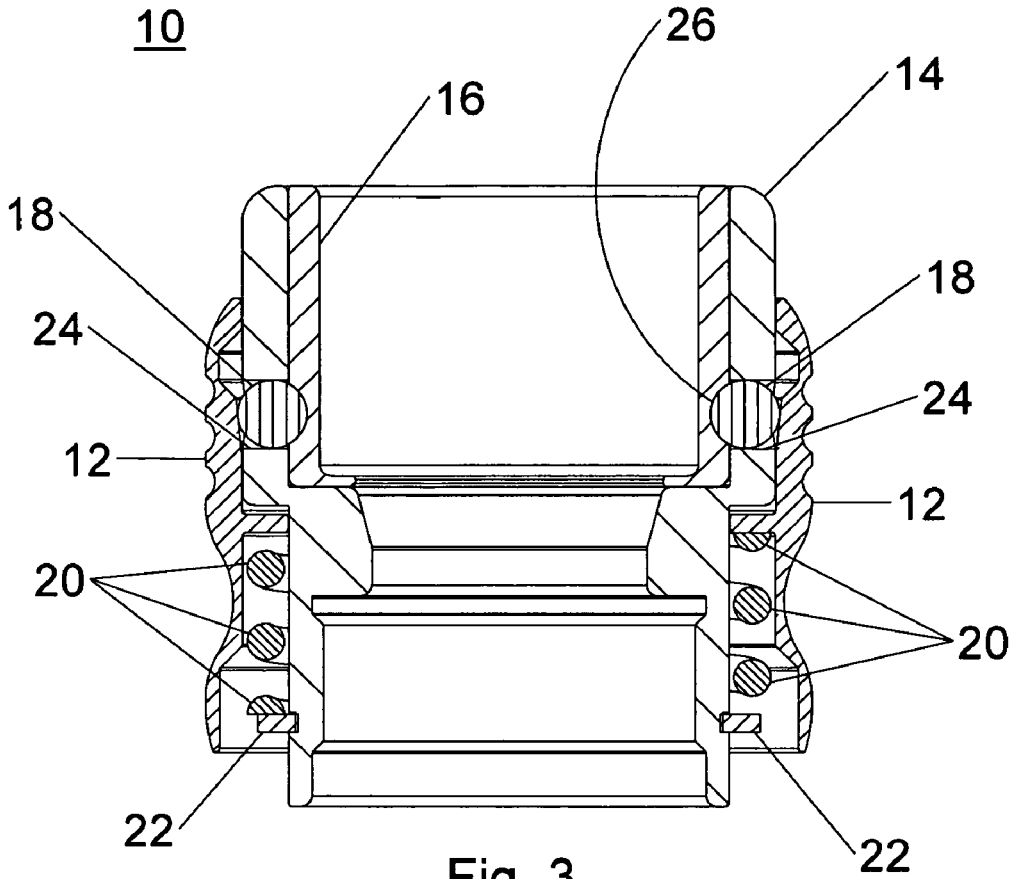
FIG. 3 is a cross-sectional view of the first embodiment of the invention of FIG. 2 taken along the line 3-3 showing the coupler in the locked position.

A cross-section view in FIG. 3, taken along the line 3-3 of FIG. 2 shows the retaining sleeve 12 that encircles the marker mount 14, and the feed neck 16 inserted into the marker mount 14. The feed neck 16 slides into the marker mount 14 until it contacts the marker mount 16 and stops. A spring 20, forcing against retainer ring 22 and a flange inside the retaining sleeve 12, urges the retaining sleeve 12 into the locked position. In the locked position, the retaining sleeve contacts spheres 18 placed in bores 24 in the marker mount 14 forcing the spheres into cavities 26 formed in the feed neck 16. The pressure of the retraining sleeve 12 on the spheres 18 holds the feed neck 16 in a fixed position and immobile in marker mount 14. The paintball hopper 36 attaches in a non-sliding manner to the feed neck 16; therefore, when the retaining sleeve 12 is in the locked position, the paintball hopper 36 is also held immobile.

Figure 4:
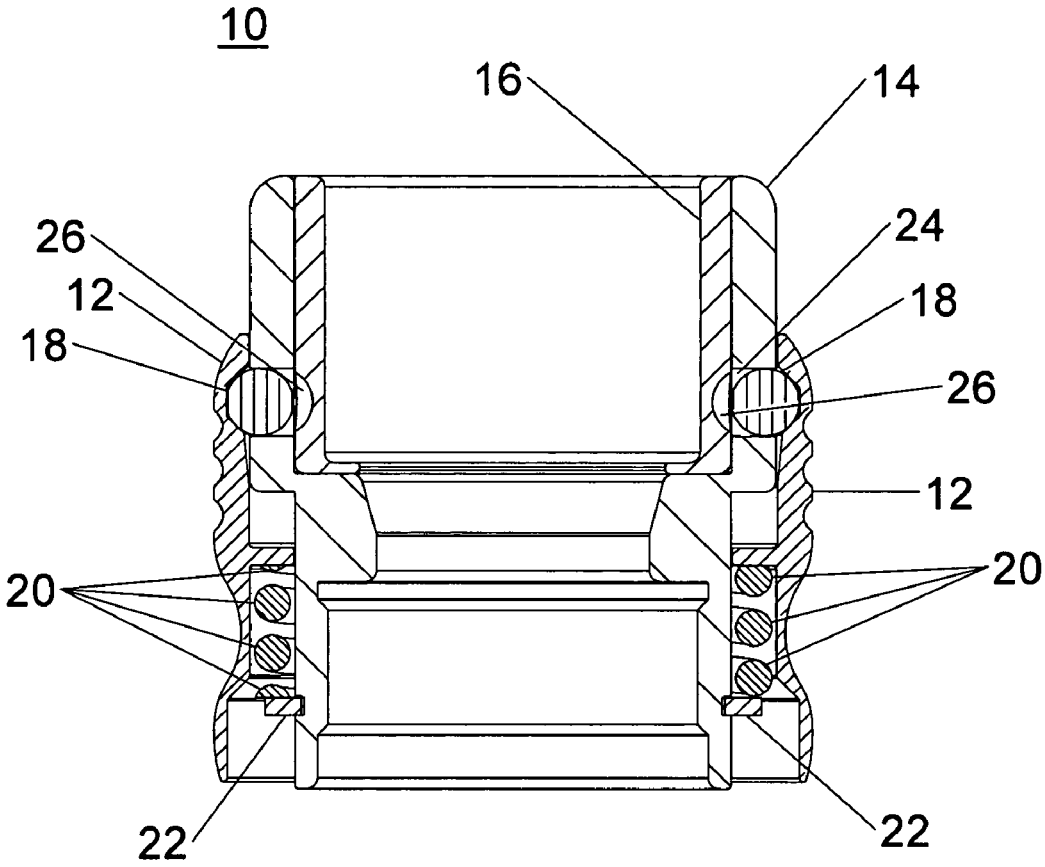
FIG. 4 is a cross-sectional view of the first embodiment of the invention of FIG. 2 taken along the line 3-3 showing the coupler in the unlocked position with the feed neck fully inserted.
Figure 5:
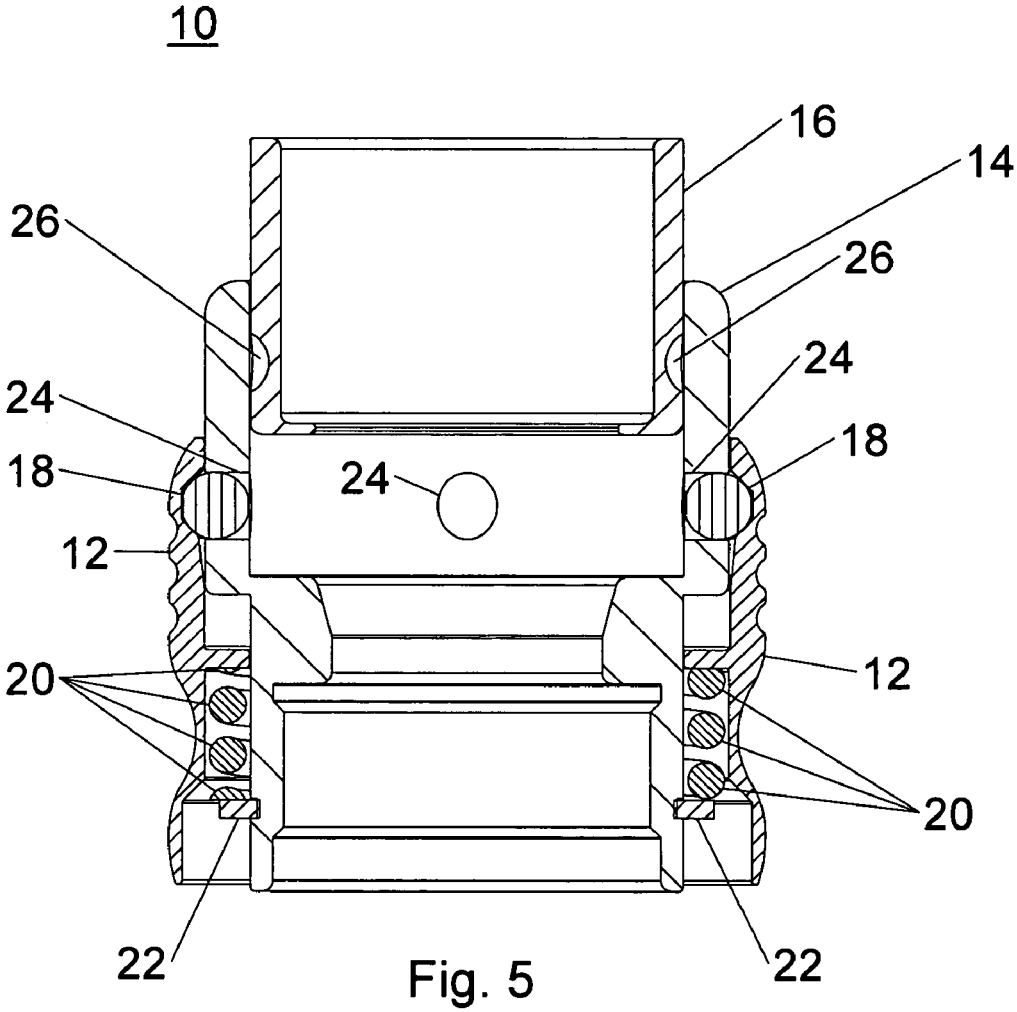
FIG. 5 is a cross-sectional view of the first embodiment of the invention of FIG. 2 taken along the line 3-3 showing the coupler in the unlocked position with the feed neck partially inserted.

Moving the retaining sleeve 12 against the force of the spring 20 places the coupler 10 in the unlocked position, as shown in FIG. 4. In the unlocked position, an annular groove in the retaining sleeve 12 aligns with each bore 24 and allows each sphere 18 to move out of each cavity 26 and into the groove. The feed neck 16 can slide out of the marker mount 14 because the spheres 18 are no longer holding the feed neck 16 immobile. The feed neck 16 is shown partially removed from the marker mount 14 in FIG. 5.

Once the feed neck 16 is moved past the spheres 18 and the retaining sleeve 12 is allowed to return to the locked position, the spheres are forced into the bores 24 and partially extend out each bore 24 into the cavity where the feed neck 16 was located. The spheres 18 are held in the bores 24 by a ledge 30, which is described below, so the spheres 18 do not fall out of the bores 24. When the feed neck 16 is inserted into the marker mount 14, the feed neck 16 easily slides into the marker mount 14 until the bottom of the feed neck 16 hits the spheres 18. The feed neck 16 stops inserting when it contacts the spheres 18, but the feed neck 16 still freely rotates because the spheres 18 are not pressed into the cavities. Moving the retaining sleeve 12 against the force of the spring 20 to the unlocked position allows the spheres 18 to retract into the bores 24 and the feed neck 16 to continue entering the marker mount 14 until the feed neck 16 stops. Even after the feed neck 16 is fully inserted into the marker mount 14, the retaining sleeve 12 is not in the locked position, and the feed neck 16 can freely rotate until the cavities 26 align with the bores 24 and the spheres 18 are forced into the cavities 26.

The use of individual cavities 26 in the feed neck 16 instead of an annular groove means that the feed neck 16 and the attached paintball hopper 36 are restricted to a limited number of locked positions. If the coupler 10 has four cavities 26, four bores 24, and four spheres 18, the paintball hopper 36 is limited to the four locked positions where the bores 24 align with the cavities 26. The number of possible locked positions increases with the number of bore 24 and cavity 26 pairs, or with the number of cavities 26 alone. For example, four bores 24 that align with four cavities 26 provide four locked positions. Six bores 24 that align with six cavities 26 provide six locked positions, etc. It is also possible to have more cavities 26 than bores 24 to allow more positions. If more cavities 26 are used than bores 24, it is preferable that the number of cavities 26 be a factor of two greater than the number of bores 24, so that each bore 24 will align with a cavity 26 in all possible locked positions. The preferred embodiment uses six bores 24, six cavities 26, and six spheres 18.

Figure 6:
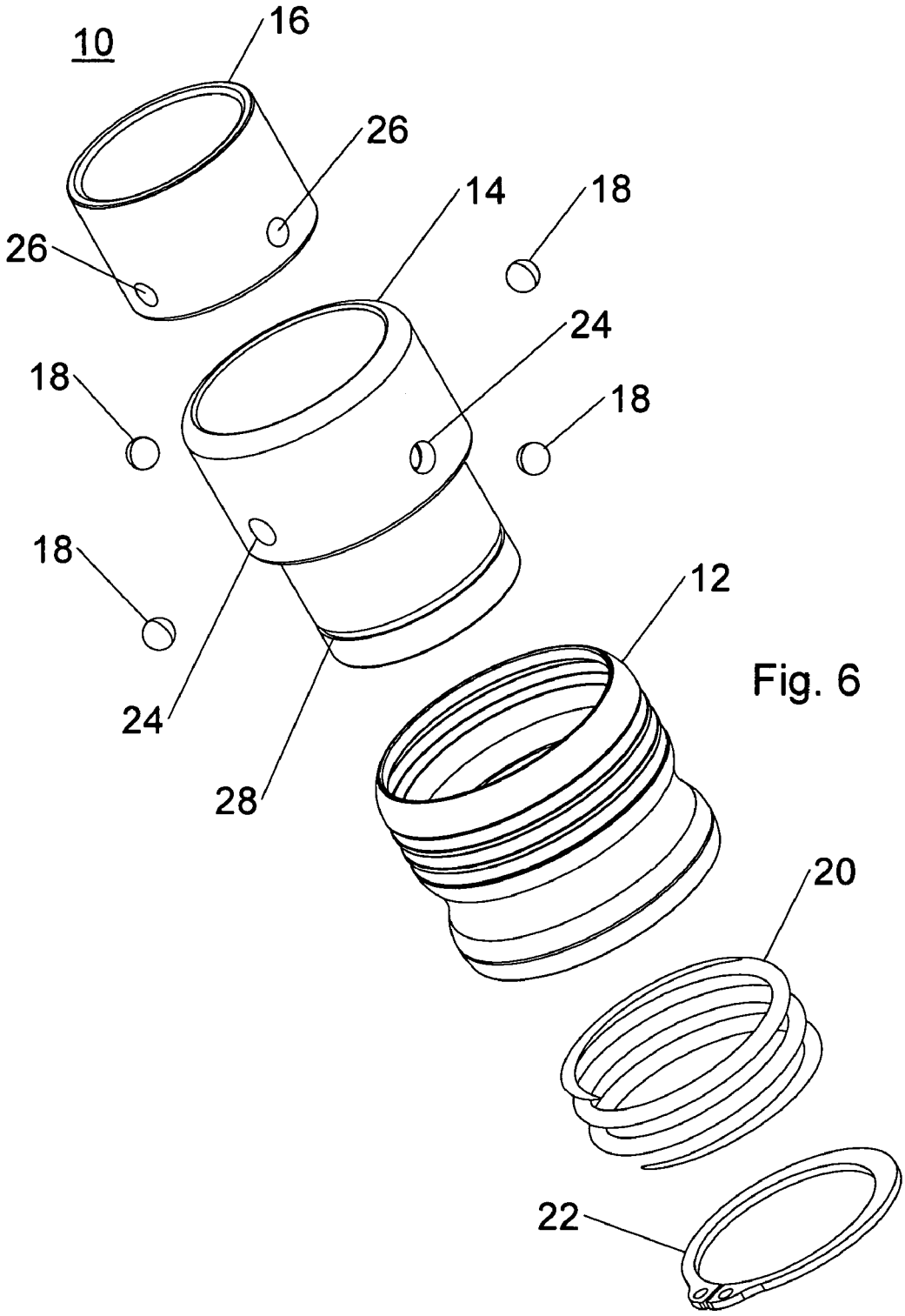
FIG. 6 is a disassembled view of the first embodiment of the invention in FIG. 1.

A disassembled view of the coupler 10 is shown in FIG. 6. The feed neck 16 slides into the top of the marker mount 14 and has individual cavities 26 that align with bores 24 in the marker mount 14. The spheres 18 are placed in the bores 24, and the retaining sleeve 12 slides up over the marker mount 14. The spring 20 goes inside the retaining sleeve 12 and around the bottom of the marker mount 14. The top of the spring 20 presses against the retaining sleeve 12. The bottom of the spring presses against a retaining ring 22 placed inside the retaining sleeve 12 and in a groove 28 around the marker mount 14. The retaining sleeve 12 moves axially between the locked and unlocked positions.

Figure 7:
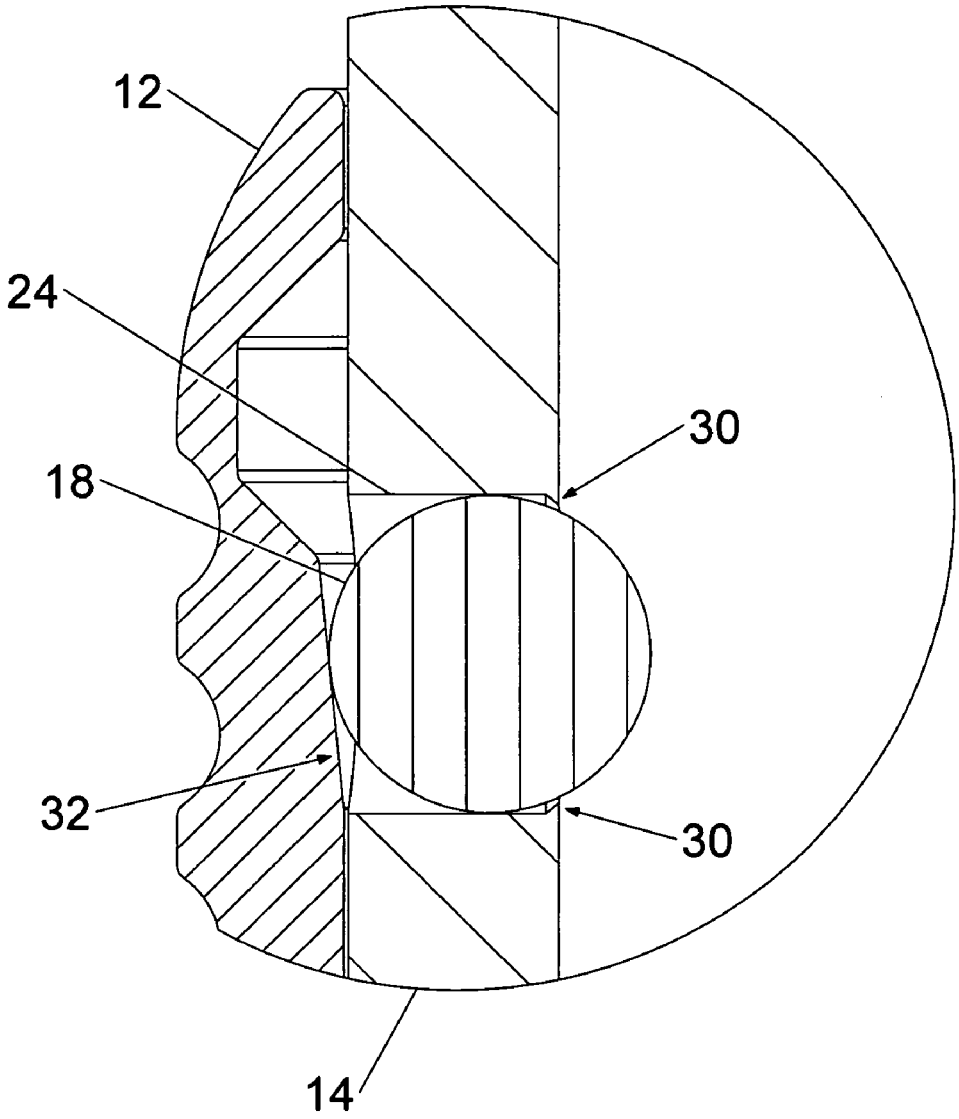
FIG. 7 is a close-up of a cross-sectional view of the first embodiment of the invention of FIG. 2 taken along the line 3-3 showing the locking ramp and retaining ledge.

More details of the first embodiment are shown in FIG. 7. As mentioned earlier, when the feed neck 16 is removed from the marker mount 14 and the retaining sleeve 12 moves back to the locked position, the spheres 18 are forced into the bores 24, but the spheres 18 do not exit the bores 24 because an annular ledge 30 in each bore 24 holds them in. The ledge 30 does not interfere with the sphere 18 when the sphere 18 is in contact with and pressed into the cavity 26, so the ledge 18 does not reduce the amount of force transferred from the spring 20 through the retaining sleeve 12, to the sphere 18, and to the cavity 26.

Another aspect of the first embodiment is the ramp 32, shown in FIG. 7. The ramp applies constant and continuous force against the sphere 18 when the retaining sleeve 12 is in the locked position. An important aspect of the invention is that the paintball hopper 36 not move when the coupler 10 is in the locked position. The ramp 32, formed circumferentially around the inside of the retaining sleeve 12, translates the position of the retaining sleeve 12 and force from the spring 20 into constant force on the spheres 18 and the cavities 26 in the locked position. The force applied on the spheres 18 and the cavities 26 can be increased by increasing the strength of the spring, by increasing the amount the spring is compressed in the locked position, or by using both methods. Limiting factors on the force applied to the retaining sleeve 12, the spheres 18, and the cavities 26 are the strength of the materials used, and the force required to move the retaining sleeve 12 from the locked to the unlocked position. The force applied can ever be so little that the retaining sleeve 12 moves, the spheres 18 regress from the cavities 26 and the feed neck 16 moves. The force can never be so great that the strength required to unlock the coupler 10 exceeds the strength of the majority of paintball marker users.

For the first embodiment, the retaining sleeve 12, the marker mount 14, and the feed neck 16 can be made of anodized aluminum, aluminum, titanium, brass, iron, steel, stainless steel, composite materials, or plastic. The preferable material is anodized aluminum.

The feed neck 16 is not limited in size or shape. The feed neck 16 can be of any size or shape required to connect to any paintball hopper 36. Preferably, the part of the feed neck 16 that inserts into the marker mount 14 is round. The exit hole of the part of the feed neck 16 that inserts into the marker mount 14 can be of any diameter in the range of one paintball diameter (approximately $^{680}/_{1000}$ of an inch) to two paintball diameters ($^{1360}/_{1000}$ of an inch). The preferred size of the feed neck 16 exit hole be slightly larger than one paintball diameter ($^{750}/_{1000}$ of an inch) to prevent two paintballs from getting jammed in the exit hole. The feed neck 16 can connect to the paintball hopper 36 using method known to the art such as with threads, clamping, or any other method. The preferred method is to have the feed neck 16 held to the paintball hopper exit tube by friction.

The marker mount 14 is not limited in size or shape. The marker mount 14 can be of any size or shape required to connect to any paintball marker 38 and to slidably accept any feed neck 16. Preferably, the part of the marker mount 14 that slidably accepts the feed neck 16 is round. Preferably, the part of the marker mount 14 that attaches to the paintball marker 38 is also round. The marker mount 14 can attach to the paintball marker 38 using any method known to the art. The preferred connection between the marker mount 14 to the paintball marker 38 is threaded. The diameter of the exit hole from the marker mount 14 into the paintball marker 38 may be set by the entrance hole to the paintball marker 38; however, if any discretion is allowed in the size of exit hole in the marker mount 14, the preferred size is slightly larger than one paintball diameter ($^{750}/_{1000}$ of an inch). Paintballs 40 range in size from $^{680}/_{1000}$ of an inch to $^{698}/_{1000}$ of an inch. An exit hole size of $^{750}/_{1000}$ of an inch ensures that paintballs will not jam in the coupler 10, but the space around the paintballs also allows any air escaping the paintball marker 38 into the coupler 10 to blow past the paintballs without disturbing them or interfering with their entrance into the marker.

The retainer sleeve 12 in the first embodiment moves axially between the locked and the unlocked positions. The locking mechanism is not limited to axial movement and the retaining sleeve 12 does not have to completely enclose the marker mount 14. The second embodiment shows a retaining sleeve 34 (see FIG. 8) that rotates between the locked and unlocked positions. The retaining sleeve 12 could also be implemented as an individual mechanism for each bore 24 or mechanisms that group the control of multiple bores 24 together. Even with a retaining mechanism that moves axially, the direction and distance required to move between the locked and unlocked positions can be varied. The first embodiment shows the retaining sleeve 12 as moving axially towards the paintball marker 38 to unlock and axially towards the paintball hopper 36 to lock. It is possible to have the retaining sleeve 12 move axially towards the paintball hopper 36 to unlock and towards the paintball marker 38 to lock. The preferred retainer sleeve is one that moves axially towards the paintball marker 38 to unlock and towards the paintball hopper 36 to lock.

Any type of device or source of force can be used to bias the retaining sleeve 12 into the locked position. Potential sources of force are springs, magnetic, latches, O-rings, rubber, urethane, or any other material or device. The preferred method of biasing the retaining sleeve 12 into the locked position is with a coil compression spring. The preferred spring provides a force of 70 pound/inches, and is used for the first embodiment.

The method of locking the feed neck 16 into position can also vary. Spheres 18 can be replaced by pins, wedges, pyramid shapes, levers or any other shape adapted to project from the marker mount 14 into the feed neck 16. The spherical cavities 26 can be substituted for square, triangular, rectangular, wedge, or any other shape. The preferred method is to use bores 24 with spheres 18 that moveably fit into the bores 24, and cavities 26 that align with the bores 24 and accept the spheres 18. The cavity 26 mirrors the shape and size of the fraction of the sphere 18 that touches the cavity 26. The depth of the cavity in the preferred embodiment is $^{50}/_{1000}$ of an inch.

Spheres 18 can be made of anodized aluminum, aluminum, titanium, brass, iron, steel, stainless steel, or plastic. The preferred material is stainless steel. The spheres 18 can vary in size from $^{1}/_{16}$ of an inch to $^{1}/_{2}$ of an inch. The preferred size of the sphere 18 depends on the number of spheres used. Generally, the size of the sphere can decrease as the number spheres used increases. The preferred size of the sphere 18 for a four bore 24, four sphere 18 coupler 10 is $^{3}/_{16}$ of an inch. The preferred size of the sphere 18 for a six bore 24, six sphere 18 coupler 10 is $^{1}/_{8}$ of an inch.

The ledge 30 that keeps the spheres 18 in the holes when the feed neck 16 is removed is not required. The ledge 30 is preferred because it keeps the spheres 18 from getting out of the bores 24 and possibly getting lost each time the paintball hopper 24 is removed. The diameter of the bore 24 in the preferred embodiment is $^{189}/_{1000}$ of an inch. The preferred sphere diameter is $^{187.5}/_{1000}$ of an inch with a tolerance of approximately $^{3}/_{10,000}$ of an inch. The ledge 30 decreases the opening at the end of the bore 24, so the sphere 18 will not go out. Decreasing the size of the ledge 30 increases the size of the opening at the end of the bore. Increasing the size of the ledge decreases the size of the opening at the end of the bore. Very small ledges form a burr that protrudes into the interior of the marker mount 14. The maximum size of the ledge 30 is the size where the sphere 18 no longer fully engages the cavity 26 while in the locked position. The ledge 30 size can be varied to produce openings at the end of the bore 24 that can range from $^{177.5}/_{1000}$ of an inch down to $^{95}/_{1000}$ of an inch for a cavity depth of $^{50}/_{1000}$ of an inch. The preferred ledge 30 decreases the opening of the bore 24 to $^{166}/_{1000}$ of an inch.

Because paintball hoppers and paintball markers are not standardized, it is necessary to make different versions of the coupler 10 to fit the various guns available on the market. It is possible to manufacture and sell a coupler individualized for each paintball hopper and paintball marker combinations available; however, manufacturing and parts management is simplified by having some common features between the retaining sleeve 12, the marker mount 14, and the feed neck 16 versions. Preferably, the outside diameter of the feed neck 16 is the same for all versions and the inside diameter individualized to fit the various paintball hoppers 36 available on the market.

Preferably, the inside diameter of the part of the marker mount 14 that slidably accepts the feed neck 16 is the same for all versions and adapted to slidably accept the constant outside diameter of the feed neck 16. Preferably, the outside diameter of the marker mount 14 part that accepts the feed neck 16 is also the same for all versions. Preferably, the outside diameter of the lower part of the marker mount 14 is the same for all versions, and any variations required to connect to different types of paintball markers is made on the inside of the lower part of marker mount 14.

Because the preferred outside diameters of the marker mount 14 are the same for all versions, the retaining sleeve 12 can be the same for all versions. The spring 20 and the retaining ring 22 can also be the same for all versions because the outside diameter of the lower part of the marker mounts 14 are the same for all versions.

It is possible to produce versions of the coupler 10 with different numbers of bores 24, spheres 18, and cavities 26; however, it is preferable that all versions of the coupler 10 have the same number of bores 24 in the marker mount 14 and the corresponding number of cavities 26 in the feed neck 16. As mentioned above, all feed necks 16 could be manufactured with a factor of two more cavities than bores 24 without creating manufacturing or parts management problems.

Referring to FIG. 8, in the second embodiment of the coupler, the retaining sleeve 34 rotates between the locked and the unlocked position instead of moving axially. The cross-sectional diagram of FIG. 8 is taken from FIG. 1 along the line 8-8. The marker mount 14 and feed neck 16 shown in FIG. 8 are substantially the same as in the first embodiment in all aspects or possible implementations. The new aspects of the retaining sleeve 34 are shown in FIG. 8. Instead of using an annular groove to allow the spheres 18 to move out of the bores 24 and away from the cavities 26 in the unlocked position, individual voids are provided for each sphere 18. Instead of using a circumferential ramp, individual ramps 32 are used for each sphere. Preferably, a torsion spring biases the retaining sleeve 34 in the locked position; however, any method of providing bias as described for the first embodiment could also be used in the second embodiment as long as the force translates into a rotational instead of an axial bias. A retaining ring 22 may or may not be used in the second embodiment. Any method known to the art can be used to retrain the object that provides the rotational bias. All other aspects of the second embodiment, such as, among other things, number and size of spheres, and ledges 30 are the same as the first embodiment.

The third embodiment retains the marker mount 14 and the feed neck 16, but uses pins and grooves for locking and providing a fixed number of locked positions. The cross-sectional diagram of FIG. 9 shows a feed neck 44 with pins extending from its surface that fit into grooves formed in the interior surface of the marker mount 42. The shape of the groove is shown in FIG. 10. The pin 50 enters the groove 52 and moves towards the horizontal part of the groove 52. As the pin approaches the horizontal part of the groove 52, the feed neck 44 compresses the o-ring 48 and wave spring 46. Once the pin reaches the horizontal portion of the groove 52, it travels horizontally until it reaches the end of the horizontal section and is forced up by the o-ring 48 and wave spring 46 into the locking portion at the end of the groove 52. The feed neck 44 with its attached paintball hopper 36 is unlocked and disconnected from the marker mount 42 and paintball marker 38 by pressing down, twisting and extracting the pin 50 from groove 52. It is also possible to have the pins extend from the marker mount 42 and have the grooves in the feed neck 44. The shape of the groove 52 is also not limited to the shape shown in FIG. 10. The groove 52 can be of any shape that allows a locking portion where the pin is forced out of the groove by at least half of the pin width and biased in the locked position.

The force to keep the feed neck 44 in the locked position is provided by the o-ring 48 and the wave spring 46. It is possible that an o-ring 48 alone would provide the necessary force. The o-ring 48 additionally holds the wave spring 46 in place. The same types of materials and techniques disclosed for the first and second embodiments can be used for the third embodiment.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for releasably coupling a provided paintball hopper to a provided paintball marker, comprising:

a marker mount having an axial passage and a plurality of bores perpendicular to the passage;

a feed neck having an axial passage and a plurality of cavities;

a plurality of spheres; and a retaining sleeve having a plurality of voids; and wherein:

the marker mount for coupling to the paintball marker;

the feed neck for coupling to the paintball hopper;

each one cavity is separate from any other cavity;

each bore having a first end portion and a second end portion respectively;

one sphere is moveably positioned in each bore;

the feed neck slidably engages the marker mount;

the retaining sleeve is biased in a locked position and rotationally movable to an unlocked position:

in the unlocked position:

each sphere partially protrudes from the first end portion of its respective bore into a respective void of the plurality of voids;

in the locked position:

each sphere protrudes from the second end portion of its respective bore into one cavity of the plurality cavities;

a portion of each sphere substantially fills its respective cavity thereby holding the feed neck rotationally immobile with respect to the marker mount.

2. The apparatus as defined in claim 1 wherein in the locked position the feed neck is held immobile against axial movement.

3. The apparatus as defined in claim 1 wherein a number of positions where the feed neck is held rotationally immobile comprises the positions where the bores align with the cavities.

4. The apparatus as defined in claim 1 further comprising a circumferential ledge in each of the bores; whereby, the ledge retains the sphere in the bore while the feed neck is disengaged from the marker mount.

5. The apparatus as defined in claim 1 wherein the axial passage is at most $^{1360}/_{1000}$ of an inch in diameter.

6. The apparatus as defined in claim 1 wherein the axial passage is at least $^{680}/_{1000}$ of an inch in diameter.

7. The apparatus as defined in claim 1 further comprising a plurality of ramps wherein each of the ramps applies force to at least one of the spheres when the feed neck is engaged with the marker mount and the retaining sleeve is in the locked position.

8. The apparatus as defined in claim 1 wherein in the unlocked position the feed neck is separable from the marker mount.

9. A paintball marker system, comprising:

a paintball hopper, a paintball marker, a coupler that releasably couples the paintball hopper to the paintball marker, the coupler comprising:

a marker mount having an axial passage and a plurality of bores perpendicular to the passage;

a feed neck having an axial passage and a plurality of cavities;

a plurality of spheres; and a retaining sleeve having a plurality of voids; and wherein:

the marker mount couples to the paintball marker;

the feed neck couples to the paintball hopper;

each one cavity is separate from any other cavity;

each bore having a first end portion and a second end portion respectively;

one sphere is moveably positioned in each bore;

the feed neck slidably engages the marker mount;

the retaining sleeve is biased in a locked position and rotationally movable to an unlocked position;

in the unlocked position:

each sphere partially protrudes from the first end portion of its respective bore into a respective void of the plurality of voids;

in the locked position:

each sphere protrudes from the second end portion of its respective bore into one cavity of the plurality cavities;

a portion of each sphere substantially fills its respective cavity thereby holding the feed neck rotationally immobile with respect to the marker mount.

10. The apparatus as defined in claim 9 wherein in the locked position the feed neck is held immobile against axial movement.

11. The apparatus as defined in claim 9 wherein a number of positions where the feed neck is held rotationally immobile comprises the positions where the bores align with the cavities.

12. The apparatus as defined in claim 9 further comprising a circumferential ledge in each of the bores; whereby, the ledge keeps the sphere in the bore when the feed neck is disengaged from the marker mount.

13. The apparatus as defined in claim 9 wherein the axial passage is at most $^{1360}/_{1000}$ of an inch in diameter.

14. The apparatus as defined in claim 9 wherein the axial passage is at least $^{680}/_{1000}$ of an inch in diameter.

15. The apparatus as defined in claim 9 further comprising a plurality of ramps wherein each of the ramps applies force to at least one of the spheres while the feed neck is engaged with the marker mount and the retaining sleeve is in the locked position.

16. The apparatus as defined in claim 9 wherein in the unlocked position the feed neck is separable from the marker mount.

17. An apparatus for releasably coupling a provided paintball hopper to a provided paintball marker, comprising:

a marker mount having an axial passage and a plurality of bores;

a feed neck having an axial passage and a plurality of cavities;

a plurality of spheres; and a retaining sleeve; and wherein:

the marker mount for coupling to the paintball marker;

the feed neck for coupling to the paintball hopper;

each one cavity is separate from any other cavity;

each bore having a first end portion respectively;

one sphere is moveably positioned in each bore;

the feed neck slidably engages the marker mount;

the retaining sleeve is biased in a locked position and rotationally movable to an unlocked position; and in the locked position:

each sphere protrudes from the first end portion of its respective bore into one cavity of the plurality cavities; and a portion of each sphere substantially fills its respective cavity thereby holding the feed neck rotationally immobile with respect to the marker mount.

18. The apparatus as defined in claim 17 wherein in the locked position the feed neck is held immobile against axial movement.

19. The apparatus as defined in claim 17 wherein a number of positions where the feed neck is held rotationally immobile comprises the positions where the bores align with the cavities.

20. The apparatus as defined in claim 17 wherein in the unlocked position the feed neck is separable from the marker mount.

* * * * *